US007328891B2

(12) United States Patent
Watanabe et al.

(10) Patent No.: US 7,328,891 B2
(45) Date of Patent: Feb. 12, 2008

(54) CLAMP TOOL

(75) Inventors: Shunsuke Watanabe, Shizuoka (JP); Masaru Yoshida, Shizuoka (JP)

(73) Assignee: Off Corporation Inc., Shizuoka-Ken (JP)

( * ) Notice: Subject to any disclaimer, the term of this patent is extended or adjusted under 35 U.S.C. 154(b) by 0 days.

(21) Appl. No.: 11/448,777

(22) Filed: Jun. 8, 2006

(65) Prior Publication Data

US 2006/0279033 A1 Dec. 14, 2006

(30) Foreign Application Priority Data

Jun. 8, 2005 (JP) ..... 2005-168792

(51) Int. Cl.
*B25B 1/02* (2006.01)

(52) U.S. Cl. ..... 269/166; 269/147; 269/282

(58) Field of Classification Search ..... 269/166, 269/147, 167–171, 282, 148–149, 265
See application file for complete search history.

(56) References Cited

U.S. PATENT DOCUMENTS

| | | | | |
|---|---|---|---|---|
| 4,552,345 | A | 11/1985 | Benda et al. | 269/43 |
| 6,338,478 | B2 * | 1/2002 | Baculy | 269/166 |
| 6,935,628 | B1 * | 8/2005 | Conversa | 269/147 |
| 7,134,651 | B1 * | 11/2006 | Beck | 269/147 |

* cited by examiner

*Primary Examiner*—Lee D. Wilson
(74) *Attorney, Agent, or Firm*—Jacobson Holman PLLC

(57) ABSTRACT

A clamp tool for woodwork or metalwork in which a screw mechanism is not apart away from a shaft and is not exposed is disclosed. In the clamp tool, a pair of clamping brackets is disposed on a shaft apart from each other and at least one clamping bracket is movable along the shaft to fasten a workpiece in cooperation with the other clamping bracket. Here, a female screw constituting a screw mechanism is disposed at one end of the shaft, a male screw constituting the screw mechanism is rotatable in a slide cylinder disposed outside at the end of the shaft so as to be screwed to the female screw, a handle for rotationally manipulating the male screw is disposed, and a guide portion is disposed between the shaft and the slide cylinder so that the female screw does not rotate but goes straight with the rotation of the male screw so as to allow the clamping bracket disposed outside the slide cylinder to move along the shaft.

2 Claims, 4 Drawing Sheets

CLAMP TOOL

BACKGROUND OF THE INVENTION

1. Technical Field

The present invention relates to a clamp tool in which a pair of clamping brackets is disposed on a shaft apart from each other, at least one clamping bracket can move along the shaft to fasten a workpiece in cooperation with the other clamping bracket.

2. Related Art

Such a kind of manual tool is used for coupling wood blocks to each other. For examples, U.S. Pat. No. 4,552,345 discloses a structure which includes a pair of clamping blocks disposed along a shaft, in which one clamping block moves toward the other clamping block to fasten a plurality of workpieces interposed between the pair of clamping blocks and a member for supporting the workpieces so as not to bow due to the fastening force. This structure is a typical example. On the other hand, a clamp is also known in which a pair of clamping brackets is formed to move or stop on a pipe-shaped shaft, one clamping bracket is movable with a screw mechanism, and the central axis of the screw mechanism is located at a position substantially equal to clamping portions of the pair of claming brackets. This clamp employs a gas pipe or a water pipe put on the market as the shaft. The pipe is cut in a proper length and the cut pipe is fitted with clamping tabs and necessary components. However, the screw mechanism is apart from the shaft and is always exposed due to a structural problem thereof. One of the pair of clamping brackets is directly made to move by the screw mechanism, while the other clamping bracket is not supported by the screw mechanism.

An example of the above-mentioned clamp is disclosed in U.S. Pat. No. 4,552,345. Pony clamps (product Nos. #50, #52, and #53) disclosed in URL (http//www.tamacraft.com/catalog2.html) which can be seen through an electrical communication network are also examples of the above-mentioned clamp.

SUMMARY OF THE INVENTION

The invention is contrived in view of the above-mentioned points. An object of the invention is that it provides a clamp tool for woodwork or metalwork in which a screw mechanism is not apart from a shaft and is not exposed therefrom. Another object of the invention is that it provides a clamp tool which can deliver a fastening force for fastening a workpiece between a pair of clamping brackets more directly to the workpiece.

An aspect of the invention provides a clamp tool for woodwork or metalwork in which a pair of clamping brackets is disposed on a shaft apart from each other and at least one clamping bracket is movable along the shaft to fasten a workpiece in cooperation with the other clamping bracket, wherein a female screw constituting a screw mechanism is disposed at one end of the shaft, a male screw which can be screwed to the female screw is rotatable in a slide cylinder disposed at the end of the shaft, a handle for rotationally manipulating the male screw is disposed at the outer end of the male screw, and a guide portion is disposed between the shaft and the slide cylinder so that the female screw does not rotate but goes straight with the rotation of the male screw so as to allow the clamping bracket disposed outside the slide cylinder to move along the shaft.

The clamp tool according to the invention includes a pair of clamping brackets and a shaft on which the clamping brackets are slidably disposed. The shaft has a hollow structure in which at least the ends are open in a pipe shape. A pipe made of mainly metal having rigidity, such as a gas pipe, a water pipe, and a scaffolding pipe put on the market, can be used as the shaft. It is preferable that the pair of clamping brackets can slide on the shaft. However, one clamping bracket which is operated by the screw mechanism may be movable and the other clamping bracket may not be movable. If the other clamping bracket is also movable, it can improve manipulability of the clamp tool.

The screw mechanism includes the female screw and the male screw which can be screwed to each other. The female screw is disposed at one end of the shaft having a pipe-shaped opening. The male screw is rotatably disposed in the slide cylinder disposed outside at one end of the shaft. One clamping bracket is disposed outside the slide cylinder. On the contrary, the other clamping bracket is disposed in a movable member, and the movable member preferably has a structure that it can move on the shaft and stop at any position.

The male screw is screwed to the female screw on the side of the shaft to move forwardly and backwardly, and a handle for rotationally manipulating the male screw is disposed at one end of the shaft outside the slide cylinder. A guide portion is formed so as not to rotate even when a relative rotational force is applied between the shaft and the slide cylinder by means of a screwing torque of the female screw and the male screw. The guide portion can include a longitudinal hole in the axis direction formed in the slide cylinder and a shaft pin attached to the shaft through the longitudinal hole so that it comes in contact with the side wall of the longitudinal hole to stop the rotation. A bias member such as a coil spring may be disposed between an end of the shaft and an inner end of the slide cylinder so that one clamping bracket is biased in a direction in which it is apart away from the other clamping bracket. In the invention, the constituent components can be easily attached and detached.

Since the invention has the above-mentioned structure and operates as described above, the screw mechanism is housed in the shaft so as not to be exposed. In addition, since the screw mechanism is disposed on the side of the shaft in one clamping bracket operating with the manipulation of the handle among a pair of clamping brackets, and the clamping bracket acts on a workpiece to be clamped similarly to the other clamping bracket, the workpiece can be interposed between both the clamping brackets in the substantially same method without leaning on any one. In addition, since the so-called arm dimension becomes smaller, the entire rigidity is increased, thereby interposing the workpiece with accurate balance.

DESCRIPTION OF THE PREFFERED EMBODIMENTS

Figure 1:
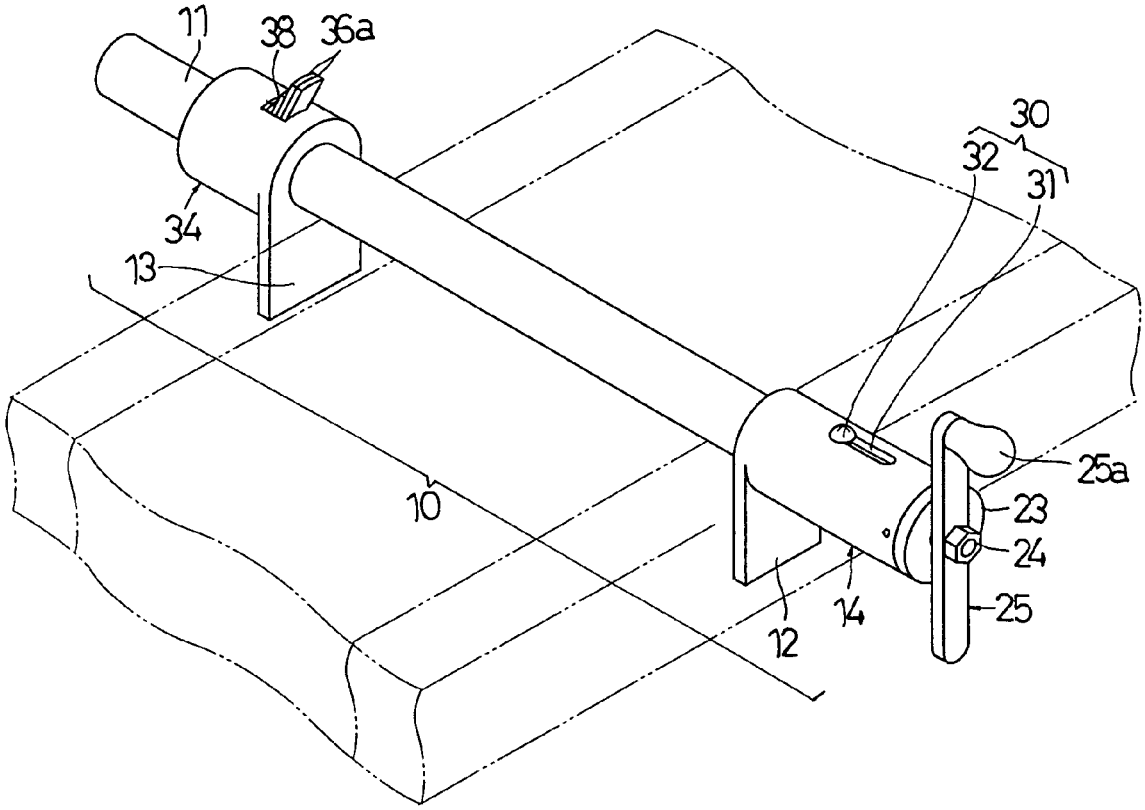
FIG. 1 is a perspective view illustrating an example of a clamp tool according to the invention.
Figure 2:
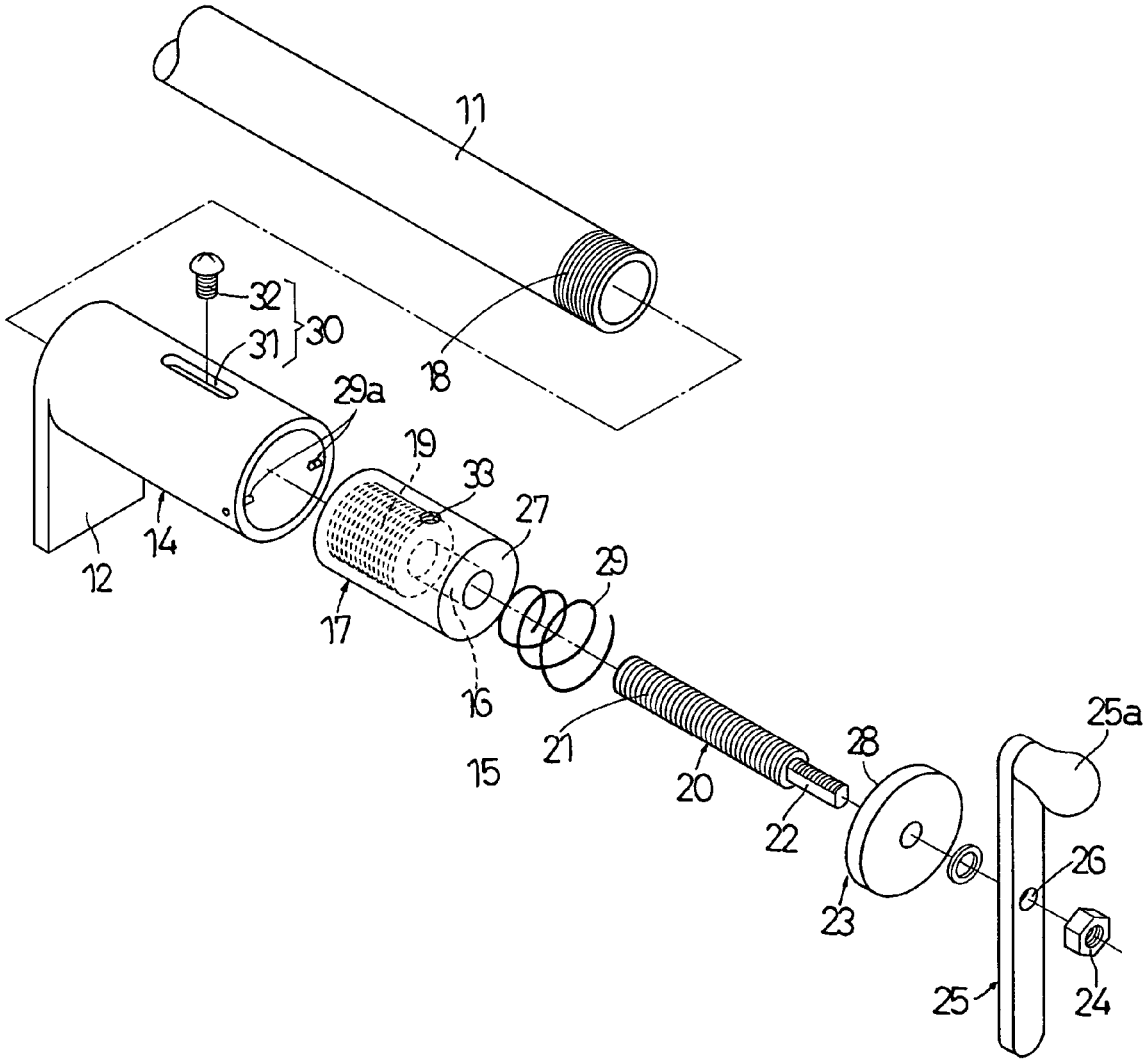
FIG. 2 is an exploded perspective view of the clamp tool.

Hereinafter, the invention will be described in detail with reference to embodiments illustrated in the drawings. FIG. 1 illustrates an example of a clamp tool 10 according to the invention, where the clamp tool includes a shaft 11 and a pair of clamping brackets 12 and 13 disposed on the shaft apart from each other. The shaft 11 has a pipe structure as a rigid body and uses a rigid pipe such as a gas pipe, a water pipe, and a scaffolding pipe as described above. Accordingly, the length of the shaft 11 can be determined as needed, and the entire inside thereof is hollow.

One clamping bracket 12 is formed integrally with a slide cylinder 14 fitted to the outside of the shaft 11 and the slide cylinder 14 is movable along the shaft 11 using a screw mechanism 15. Accordingly, an end member 17 having a female screw 16 constituting a screw mechanism 15 is attached to an end of the shaft 11. Reference numerals 18 and 19 denote screwing portions for attaching the end member 17 to the end of the shaft. The screw mechanism 15 includes the female screw 16 and a male screw 21 screwed to the female screw 16 and the male screw 21 is formed on a handle shaft 20.

The handle shaft 20 has a shaft end 22 located outside and an end plate 23 and a handle 25 are axially fixed thereto with a nut 24. The shaft end 22 is in key-engagement with to a shaft hole 26 of the handle 25 due to its sectional shape. A coil spring is interposed as a bias member 29 between the end surface 27 of the end member 17 which is an end of the shaft and the inner surface 28 of the end plate 23 which is an inner end of the slide cylinder and serves to bias one clamping bracket 12 in a direction in which it is apart away from the other clamping bracket 13. Reference numeral 29*a* denotes a detachment preventing pin of the coil and is attached to the front end of the slide cylinder 14.

A guide portion 30 is formed between the shaft 11 and the slide cylinder 14 so that the female screw goes straight without rotating by means of the rotation of the male screw. The guide portion 30 includes a longitudinal hole 31 in the axis direction formed in the slide cylinder 14 and a shaft pin 32 which is attached to the end member 17 as an inner shaft member and which engages with the longitudinal hole 31. The shaft pin 32 is screwed into and attached to a screw hole 33 formed in the end member 17.

Figure 4:
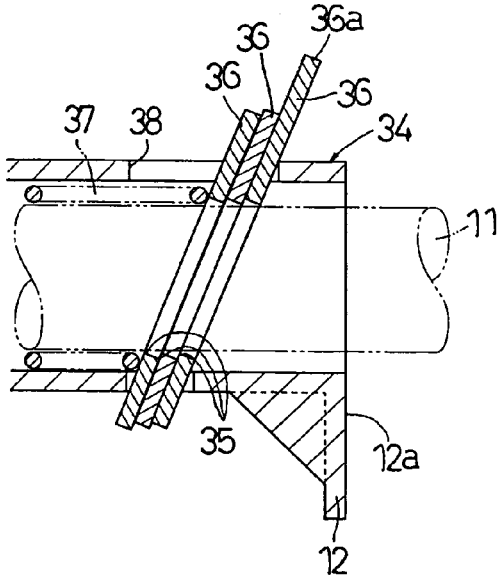
FIG. 4 is a cross-sectional view illustrating the other clamping bracket.

The other clamping bracket 13 is disposed in a movable member 34 so as to move on the shaft and stop at any position with respect to one clamping bracket 12. The movable member 34 is fitted with a plurality of engagement pieces 36 having a through-hole 35 for transmitting the shaft 11, and the edges of the through-holes 35 wedge in the outer circumferential surface of the shaft 11 at the time of tilting so as to be fixed to the shaft (see FIG. 4). A spring is combined as a bias member 37 for biasing and tilting the engagement pieces 36 in the engagement direction. Reference numeral 36*a* is a manipulation portion and is used for standing up and moving the tilted engagement pieces 36. Reference numeral 38 denotes a manipulation window. Reference numeral 25*a* denotes a handle knob.

Figure 3:
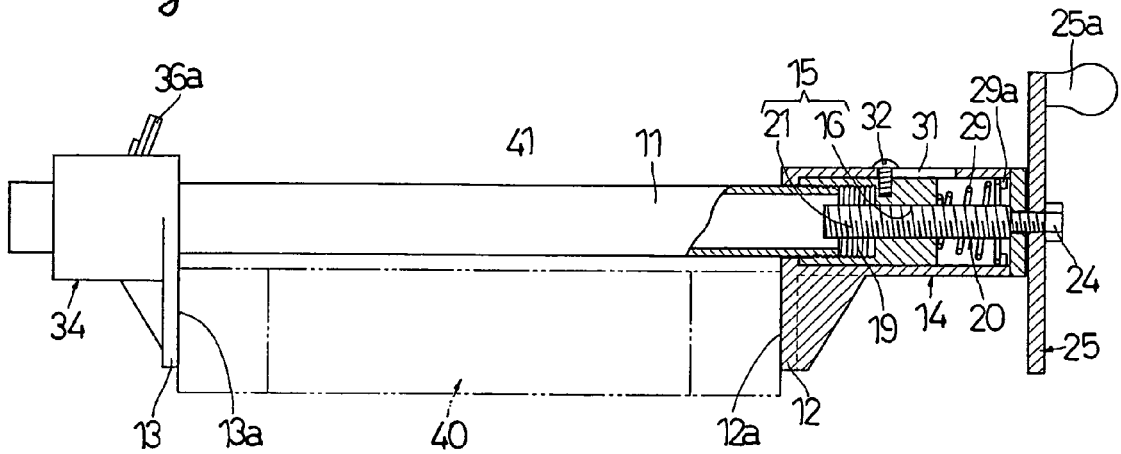
FIG. 3 is a partially sectioned side view of the clamp tool.
Figure 5:
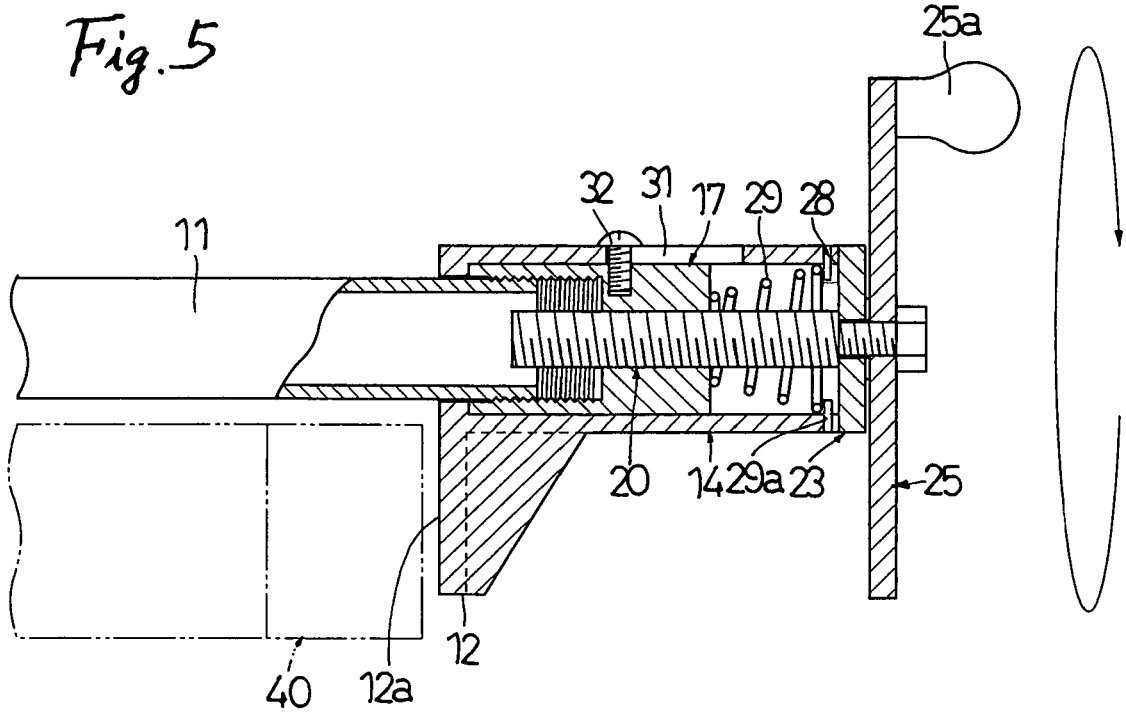
FIG. 5 is a cross-sectional view illustrating a fastening operation.
Figure 6:
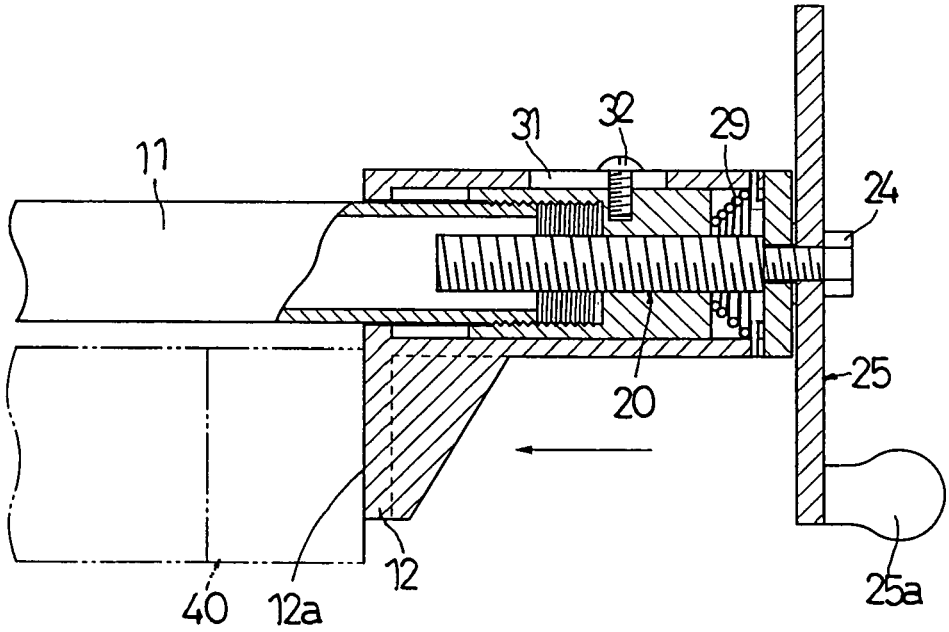
FIG. 6 is a cross-sectional view illustrating a fastening operation.

In the clamp tool 10 according to the invention having the above-mentioned structure, a pair of clamping brackets 12 and 13 come in contact with both sides of a target workpiece 40 and one clamping bracket 12 is fastened by the use of the screw mechanism 15 (see FIG. 3). As shown in detail in FIGS. 5 and 6, for example, when the screws are right screw and the handle 25 is turned to the right, the screw coupling of the female screw 16 and the male screw 21 is performed and one clamping bracket 12 approaches the other clamping bracket 13. Accordingly, the clamping bracket 12 sandwiches and fastens the target workpiece 40 along with the other clamping bracket 13, thereby maintaining the fastened state, for example, until an adhesive of the workpiece 40 is dried. The bias member 29 is compressed by means of the fastening manipulation. Accordingly, when the clamping bracket 12 is apart away from the other clamping bracket after the work is finished, the clamping bracket 12 can be easily restored to the original position with the restoring force of the bias member 29.

Contact surfaces 12*a* and 13*a* of the clamping bracket 12 and the other clamping bracket 13 are preferably perpendicular to a shaft line 41 of the shaft 11 (see FIG. 3). In the invention, the clamping bracket 12 is supplied with a driving force of the screw mechanism 15 on the shaft, and the contact surface 12*a* and the contact surface 13*a* of the other clamping bracket 13 are slightly apart from the shaft 11 similarly, but both contact surfaces 12*a* and 13*a* equally act on the workpiece 40. The rotational force resulting from the rotation of the handle 25 hardly acts on the workpiece 40.

In the invention, the handles shaft 20 is disposed in the slide cylinder 14. Accordingly, when the workpiece is processed in the state where it is clamped, processing shavings are not attached thereto, thereby causing no problem for work. Since the shaft 11 and the slide cylinder 14 are formed integrally with each other, it is possible to prevent deformation or damage of the shaft, unlike the conventional case where a weight is loaded on an end of a male screw. In addition, since the invention can be constructed so that all the components are detachable, it is possible to easily repeat disassembly and assembly of the components.

What is claimed is:

1. A clamp tool for woodwork or metalwork comprising a pair of clamping brackets spaced apart from each other and disposed on a shaft, wherein at least one clamping bracket is movable along the shaft to fasten a workpiece in cooperation with the other clamping bracket;

a female screw member being disposed at one end of the shaft;

a male screw member screwed to the female screw member being rotatable in a slide cylinder disposed outside at the end of the shaft;

a handle for rotationally manipulating the male screw member being disposed at an outer end of the male screw member; and a guide portion being disposed between the shaft and the slide cylinder so that the female screw member does not rotate but moves axially by the rotation of the male screw member so as to allow the clamping bracket disposed outside the slide cylinder to move along the shaft.

2. The clamping device of claim 1, wherein a bias member is disposed between an end of the shaft and an inner end of the slide cylinder so that one clamping bracket is biased in a direction in which said one clamping bracket is apart away from the other clamping bracket.

* * * * *